US005107763A

United States Patent [19]

Gevis

[11] Patent Number: 5,107,763

[45] Date of Patent: Apr. 28, 1992

[54] NARROW GAP PLATE MOUNTING APPARATUS AND METHOD

[75] Inventor: Albert Gevis, Oakbrook, Ill.

[73] Assignee: Rockwell International Corporation, El Segundo, Calif.

[21] Appl. No.: 710,249

[22] Filed: Jun. 3, 1991

Related U.S. Application Data

[63] Continuation of Ser. No. 513,538, Apr. 24, 1990, abandoned.

[51] Int. Cl.[5] ..... B41F 27/00

[52] U.S. Cl. ..... 101/415.1; 101/384; 101/382.1; 101/395

[58] Field of Search ..... 101/415.1, 378, DIG. 36, 101/382.1, 383, 384, 395, 408, 409; 51/376, 377

[56] References Cited

U.S. PATENT DOCUMENTS

| | | | |
|---|---|---|---|
| 3,408,933 | 11/1968 | Hermach | 101/415.1 |
| 3,410,211 | 11/1968 | Grünig | 101/415.1 |
| 3,540,376 | 11/1970 | Corse | 101/415.1 |
| 3,584,580 | 6/1971 | Schulz | 101/415.1 |
| 3,844,214 | 10/1974 | Smith | 101/415.1 |
| 4,217,825 | 8/1980 | Bruckner | 101/415.1 |
| 4,426,931 | 1/1984 | Vogt | 101/415.1 |
| 4,598,642 | 7/1986 | Saüer et al. | 101/415.1 |
| 4,766,811 | 8/1988 | Linska | 101/415.1 |
| 4,829,896 | 5/1989 | Norkus | 101/486 |
| 4,890,555 | 1/1990 | Bryer et al. | 101/415.1 |
| 5,010,818 | 4/1991 | Wallschlager | 101/415.1 |

*Primary Examiner*—Edgar S. Burr
*Assistant Examiner*—Eric Raciti
*Attorney, Agent, or Firm*—C. B. Patti; V. L. Sewell; H. F. Hamann

[57] ABSTRACT

A narrow gap printing plate mounting apparatus includes a printing plate (10) with a substantially curved, preferably involute tail member (24) at one end of a printing plate body (12) which is received through a narrow mating gap (20) in a rotary cylinder (18) and held against correspondingly curved cavity wall (28) by means of a resilient locking member (30). The locking member (30) presses the curved tail member (24) against the curved wall (28) in a direction which is substantially normal thereto to reduce longitudinal strain on the tail member (24). Another tail member (22) is inserted at the leading edge (20A) of the gap (20) while the curved tail member (24) presses against the lagging edge (20B) of the slot (24). When removing the plate from the cylinder (18), the curved tail member (24) at the lagging edge (20B) is removed first.

31 Claims, 2 Drawing Sheets

NARROW GAP PLATE MOUNTING APPARATUS AND METHOD

This application is a continuation of application Ser. No. 07/513,538, filed Apr. 24, 1990, now abandoned.

BACKGROUND OF THE INVENTION

This invention relates to a printing plate mounting apparatus for releasibly connecting a printing plate to a rotary cylinder of a printing press and, more particularly, to such a mounting apparatus in which the plate is mounted by means of tail members at opposite ends which are held within a longitudinal mounting gap in the surface of the cylinder.

It is well known to mount a printing plate to a rotary cylinder of a printing press by means of tail members at opposite ends of the planar, flexible body of a printing plate which are releasibly held within a cavity beneath an elongate, longitudinal, mounting slot, or gap, in the surface of the cylinder.

The plate, or plate body, and the tail members, which are integrally formed therewith from rolled steel or other suitable material, have a thickness of approximately eight to twelve mils. With known printing plates of this type, the smallest gaps which can be used are at least ten times the thickness of the plates. Specifically, the smallest gap known to operate successfully is approximately 123 mils thick.

The gaps in the surface of a rotary cylinder tend to imbalance the cylinder which causes vibrations that can cause streaking at higher press speeds. It is well known that the larger the gap, the greater the vibration and the greater resultant streaking problem. Accordingly, many efforts have been made to reduce the gap to a smaller dimension than has so far been possible or to eliminate the gap entirely.

In known printing plate mounting assemblies, the tail members are both substantially planar and extend at acute angles to overlie the printing plate body. The tail at the leading edge is inserted in the gap and hooks around an edge. The flexible body is then wrapped around the cylinder until the tail at the opposite end of the body is located opposite the gap. It is then inserted in the gap alongside the leading edge tail member and locked in place.

With known printing plates, the gaps are so large, the locking mechanism often must longitudinally strain the tail member to keep it in place which can cause distortion of the tail member. This distortion is preferably avoided since it can cause jamming of the tail member within the slot and hinder or prevent subsequent removal even when the gap is relatively large. Even without distortion, attempts to reduce the gap to less than a minimum gap size of approximatley 123 mils results in difficulties in inserting the one tail member in the gap after the other tail has already been inserted. Moreover, small gap sizes can create unacceptable difficulties in removing the tail members after insertion with known printing plates.

SUMMARY OF THE INVENTION

It is therefore an object of the present invention to provide a printing plate mounting apparatus which enables a substantial reduction in the minimum size of the mounting gap compared to known mounting apparatus and in which locking mechanism that strain the printing plate can be avoided.

It is also an objective to provide a printing plate apparatus that employs a tail locking mechanism which functions to hold the tail within the gap without straining the tail member or the printing plate body to which it is attached.

Both of these basic objectives are achieved in part through provision of a printing plate having a planar body extending between a pair of opposite ends for mounting to the surface of a rotary cylinder of a printing press by means of a mounting gap for holding the body to the cylinder at said opposite ends with a narrow gap plate mounting apparatus. The narrow gap plate mounting apparatus comprising a first tail member at one of said opposite ends and extending away from the planar body for receipt within the mounting gap, and a second tail member at the other one of said opposite ends and extending away from the planar body for receipt within the mounting gap together with the substantially planar tail member, which unlike known planar tail members, is substantially curved.

Preferably, the curved shape is at least approximately involute, i.e. the locus of a fixed point on a taut, inextensible string as it unwinds from a fixed plane curve. In the preferred embodiment, the substantially curved tail member includes a plurality of substantially planar tail member segments interconnected to approximate the curved shape of the substantially curved tail member.

The objectives are also achieved, in part, through provision of a narrow gap mounting apparatus including a cavity within a printing press cylinder and in communication with the gap which has a substantially curved wall to mate with the substantially curved one of the tail members received through the mounting slot and means for pressing the curved one of the tails against the curved wall to hold it within the cavity.

An improved method of mounting a printing plate to a cylinder of a rotary printing press is then also provided which enables use of a much narrower gap than previously could be used comprising the steps of bending the opposite ends of printing plate stock to form a pair of first and second mounting tail members at opposite ends of an intermediate planar body with the second tail member being bent in a curved shape inserting the first tail member in a mounting slot in the cylinder conveying the intermediate body around the cylinder and inserting the second, curved tail member into the slot between a lagging edge of the slot and the first tail member. In the preferred embodiment, the second tail member is bent in an approximate involute shape.

Achieving the second objective of the invention, a narrow gap plate mating apparatus for a cylinder is also provided which reduces strain on the tail member comprising a cavity within the cylinder and having a pair of walls extending from the gap which are conformed relative to the pair of tails to receive them in mating, overlying relationship when fully inserted in the gap, a locking mechanism within the cavity including a locking member and means for moving the locking member to press one of the tail members against its mating wall in a direction substantially transverse thereto to frictionally hold it within the cavity.

BRIEF DESCRIPTION OF THE DRAWINGS

The foregoing objects, advantages and features of the invention will be described in greater detail and further objects, advantages and features will be made apparent from the detailed description of the preferred embodiment which is given with reference to the several figures of the drawing, in which.

DETAILED DESCRIPTION

Figure 1:
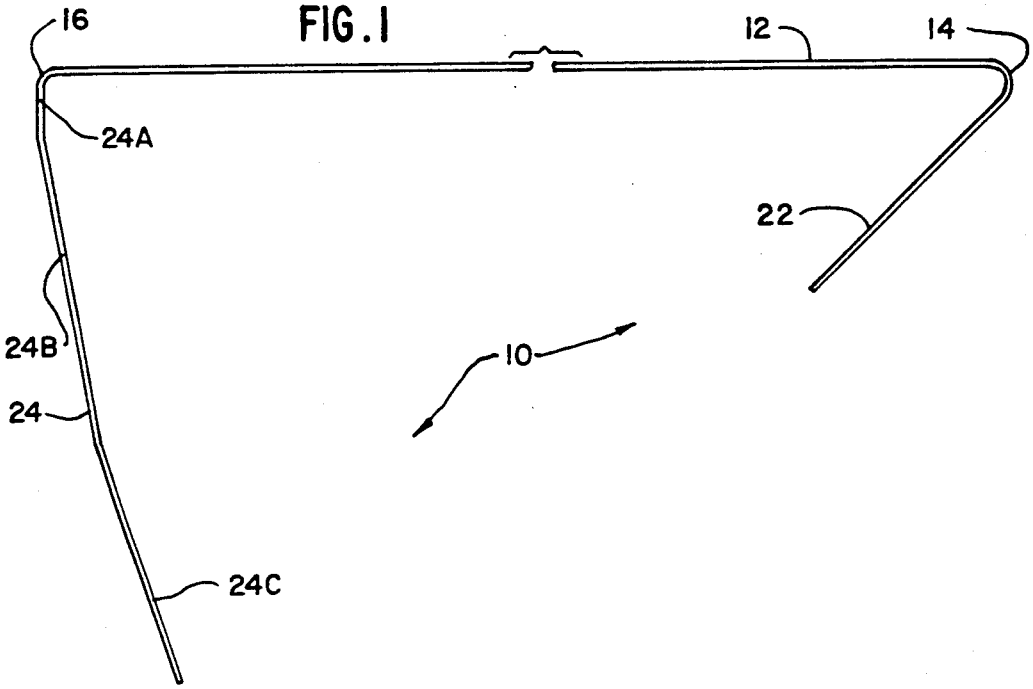
FIG. 1 is a sectional side view of a printing plate assembly with the narrow gap plate mounting apparatus of the present invention.
Figure 2:
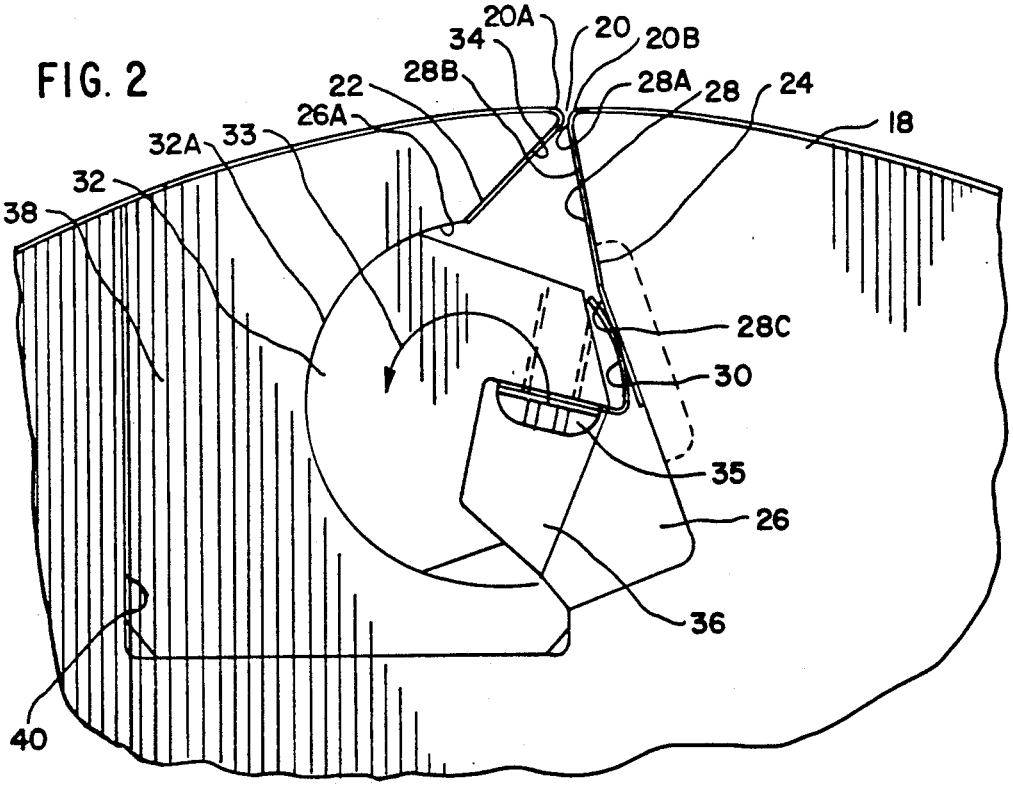
FIG. 2 is a schmatic sectional end view of a printing plate cylinder with the preferred embodiment of the narrow gap plate mounting apparatus of the invention associated therewith and shown as mounting the printing plate of FIG. 1.

Referring now to FIGS. 1 and 2, a preferred embodiment of a printing plate 10 incorporating the narrow gap plate mounting apparatus is seen to have a planar body 12 extending between a pair of opposite ends 14 and 16. The planar body 12 is made of flexible, rolled steel or the like having a thickness of approximately eight to twelve mils. The length of the plate 10 between ends 14 and 16 is matched to the circumference of the plate cylinder 18 which in this particular embodiment is approximately twenty-one inches. The length is also matched to that of the cylinder 18 which may vary from approximately two to five feet. The planar, resilient body 12 of the plate 10 is mounted by wrapping the body around the surface of the cylinder 18. After being wrapped, the body is held to the cylinder 18 at the opposite ends by means including the narrow gap mounting apparatus including a first tail member 22 and a second, substantially curved tail member 24. The term "curved" in describing the tail member 24 should be understood to means that the tail member has a curved shape which, as shown in FIG. 1, is maintained independently of any holding mechanism which can bend or hold the tail member 24 in a curved condition only when it is attached to the cylinder.

The first tail member 22 is of planar configuration and extends away from and over the planar body 12 to form an acute angle therewith of approximately forty-four degrees. The length of the first tail member 22 is 0.362 inches, and is joined at the end 14 by a bend having a radius of 0.015 inches.

The second, curved tail member 24 at the other opposite 16 also extends away from and over the planar body 12 for receipt within the mounting gap, or slot, 20 together with the substantially planar tail member 22. In keeping with the present invention, the objectives are achieved by providing the second tail member with a substantially curved configuration. Preferably, the substantially curved tail 24 has a curved shape which is at least approximately involute.

Because of difficulties in manufacture, the substantially curved shape is achieved by providing a plurality of substantially planar tail member segments 24A, 24B and 24C which are interconnected to approximate the substantially curved shape of the second tail member 24. In the preferred embodiment shown in FIG. 1, the three planar tail member segments 24A, 24B and 24C are interconnected to approximate an involute shape. In the particular printing plate shown in FIG. 1, the lengths of segments 24A, 24B and 24C are 0.068 inches, 0.393 inches and 0.318 inches, respectively. The segment 24A forms a right angle with the body 12 and has a bend radius of 0.010. The middle segment 24B forms an angle of eighty-seven degrees and the distal segment 24C forms an angle of approximately seventy degrees relative to the planar body 12. The maximum bend radius for the bends at the beginning of segments 24B and 24C is 0.030 inches. While this specific configuration and dimensions for approximating a substantially curved shape for tail 24 has worked successfully, it should be appreciated that variations may be made while still retaining the advantages of the invention.

Still referring to FIG. 2, the aspect of the plate mounting apparatus associated with the cylinder 18 is seen to include a cavity 26 within the cylinder 18 and in communication with the gap 20 which has a substantially curved wall 28. The curve of wall 28 is selected to congruently mate with the substantially curved tail member 24. As seen in FIG. 2, the wall 28 extends inwardly from edge 20B and is backwardly curved underneath the cylindrical surface of cylinder 18 adjacent edge 20B. The substantially curved wall 28, conforming to the substantially curved tail member 24 of FIG. 1, has three planar segments 28A, 28B and 28C for respectively mating with the curved tail member segments 24A, 24B and 24C to approximate an involute curve. In any event, the substantially curved tail member 24 snugly fits against the substantially curved wall 28 when the tail member 24 is fully inserted through the gap 20.

Once in place, as shown in FIG. 2, a curved, resilient locking member 30 of a rotatable locking mechanism is pressed against the substantially curved tail member 24 at its distal segment 24C to cause it to resiliently press against the curved wall 28 to frictionally hold it within cavity 26. The locking mechanism includes a lock rotor 32 mounted for rotation within the cavity about an axis parallel to that of the cylinder 28 and defined by a cylindrical wall 26A of the cavity 26. When rotated in the direction of arrow 33 from the locked position shown in FIG. 2 to an unlocked position, the resilient locking member 30 is disengaged from the curved wall 28.

The resilient locking member 30 is releasably attached to the rotor 32 by means of a plurality of screws 35 which are fastened to the underside of a channel 36 provided for that purpose. Opposite the channel, the rotor 32 has a cylindrical wall portion 32A which is rotatably supported within a matching cylindrical wall portion 26A of the cavity 26.

The curved cavity wall 26A joins with a planar wall 34 which ends at the leading edge 20A of the gap 20 and conforms to the first planar tail member 22. Planar wall 34 is formed in the side of an insert 38 fitted into an irregularly shaped groove 40 in the cylinder 18, while the planar wall segments 28A, 28B and 28C are defined by the walls of the slot 40 itself.

Figure 3:
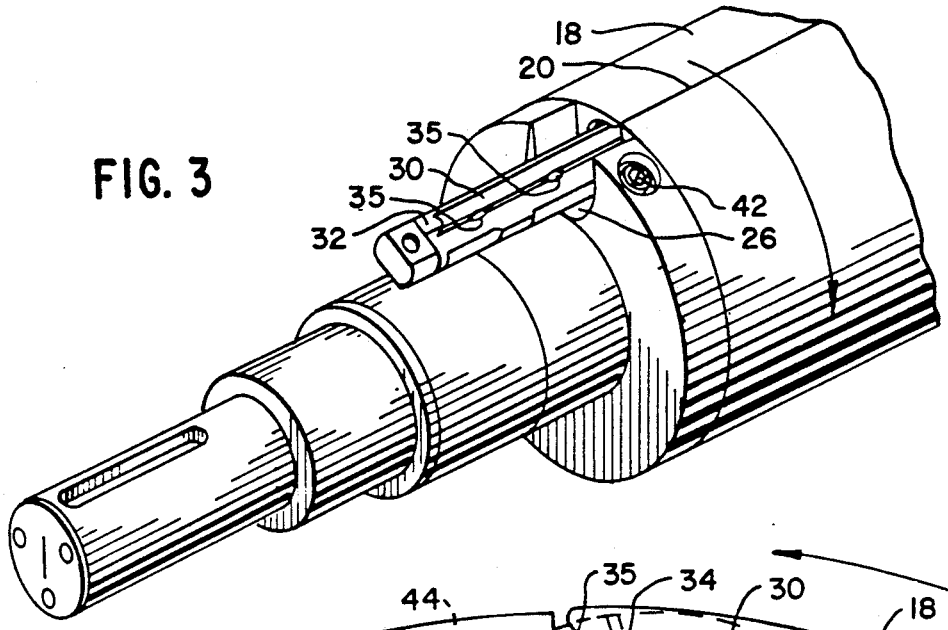
FIG. 3 is a perspective view of the preferred form of the locking mechanism of FIG. 2 partially removed from its associated cylinder to better illustrate the details thereof.

Referring to FIG. 3, the lock rotor 32 is seen to be slideably removable from the cavity 26 at one end of cylinder 18 and is locked adjacent an adjustment screw 42.

Figure 4:
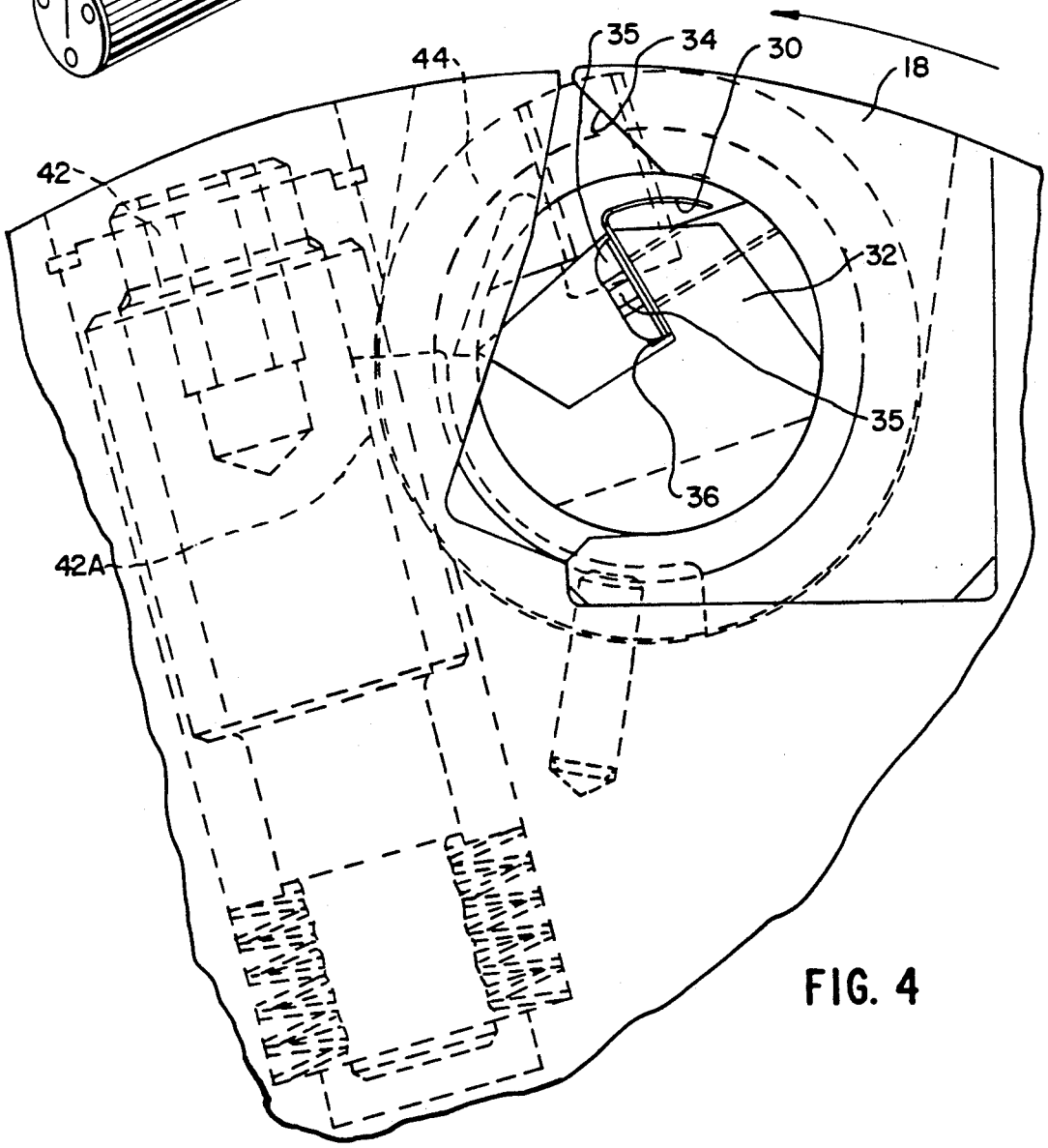
FIG. 4 is a cross sectional end view through the cylinder and locking mechanism of FIG. 3 with the locking mechanism fully installed and in the unlocked position.

Referring now to FIG. 4, viewing a section normal to the axis of the cylinder in front of an adjustment screw 42 of FIG. 3, a worm gear 44 is connected to the lock rotor 32 and engages a threaded section 42A of the adjustment screw 42. Accordingly, when the adjustment screw 42 is rotated in one direction, the worm gear 44 and, thus, the lock rotor 32 and resilient locking arm are rotated in one direction to the unlocked position shown in FIG. 2. When the adjacent screw 42 is rotated in the other direction. the worm gear 44 causes the lock rotor 32 to move to the unlocked position shown in FIG. 4.

The printing plate body 12 is mounted to the cylinder 18 by first fully inserting the planar tail member 22 into the gap and then wrapping the body 12 around the cylinder 18 in the direction of its normal rotation. After the planar body has been wrapped all the way around the cylinder 18, the curved tail member is fully inserted through the gap 20 between the lagging edge 20B of gap 30 and the first, planar tail member 22. The narrow gap eliminates the need for a locking mechanism which strains the tail member by pulling on it. Accordingly, the locking member 30 which only presses against the tail member 24 in a normal direction is employed to hold the curved first member 24 against the wall 28 after they are aligned.

While a particular embodiment has been described in detail, it should be appreciated that many variations may be made thereto without departing from the scope of the invention as defined in the appended claims.

I claim:

1. In a printing plate having a planar body extending entirely between a pair of opposite ends for mounting to the surface of a rotary cylinder of a printing press, said cylinder having a mounting gap for holding the body to the cylinder at said opposite ends, the improvement being a narrow gap plate mounting apparatus, comprising:

a first tail member at one of said opposite ends and extending away from the planar body for receipt within the mounting gap; and a second, substantially curved tail member at the other one of said opposite ends and extending away from the planar body for receipt within the mounting slot together with the first tail member, said substantially curved tail member having an approximately involute shape.

2. The printing plate of claim 1 in which the curved tail member includes a plurality of substantially planar tail member segments interconnected to approximate the curved shape of the curved tail member.

3. The printing plate of claim 1 in which the first tail member is substantially noncurved.

4. The printing plate of claim 1 in which said substantially curved tail member includes a plurality of segments interconnected to approximate an involute shape.

5. The printing plate of claim 4 in which at least some of said segments are substantially noncurved and planar.

6. In a cylinder of a rotary printing press having a gap in its cylindrical surface for mounting receipt of a pair of tail members at opposite ends of a flexible body of a plate wrapped around the cylinder, the improvement being a narrow gap mounting apparatus for holding the tail members within the mounting gap, comprising:

a cavity within the cylinder and in communication with the gap with a fixed wall extending inwardly from one edge of the gap which is inwardly curved backwardly underneath the cylindrical surface adjacent the one edge to mate with a substantially curved one of the tail members received through the mounting slot; and means for pressing the curved one of the tail members against the curved wall to frictionally hold it within the cavity.

7. The printing press cylinder of claim 6 in which said cavity has a second wall opposite the curved wall that is substantially noncurved for mating with a substantially noncurved one of the pair of tail members.

8. The printing press cylinder of claim 7 in which said pressing means includes a locking member located between the curved wall and the second wall for pressing the curved tail member against the curved wall.

9. The printing press cylinder of claim 8 in which said pressing means includes means for rotating said locking member within the cavity between a locked position in which it causes the curved tail member to be pressed against the curved wall, and an unlocked position in which the curved tail member is not pressed against the curved wall.

10. The printing press cylinder of claim 8 in which said locking member is resilient.

11. The printing press cylinder of claim 6 in which said pressing means presses against a curved tail member in a direction which is substantially normal to a plane of contact therewith to substantially reduce longitudinal strain on and distortion of the curved tail.

12. The printing press cylinder of claim 6 in which said curved wall is approximately involute.

13. The printing press cylinder of claim 6 in which said wall has a plurality of wall segments interconnected to approximate a substantially curved shape of the curved wall.

14. The printing press cylinder of claim 6 in which said walls are separated in a fixed position to provide the gap with a permanent dimension substantially less than 0.123 inch.

15. The printing press cylinder of claim 6 in which said gap is selected to have a fixed dimension less than 0.050 inch larger than the thickness of the plate body.

16. The printing press cylinder of claim 6 in which said gap has a leading edge and a lagging edge, and the curved wall joins with the lagging edge.

17. The printing press cylinder of claim 6 in combination with a printing plate with a substantially curved tail member pressed against the substantially curved wall.

18. The printing press cylinder of claim 17 in which both the substantially curved tail member and the substantially curved wall are substantially involute in shape.

19. A method of mounting a printing plate to a cylinder of a rotary printing press, comprising the steps of:

bending the opposite ends of a printing plate stock to form a pair of first and second tail members at opposite ends of an intermediate planar body with said second tail member being bent in a substantially involute shape;

inserting the first tail member in a mounting slot in the cylinder;

conveying the intermediate body around the cylinder;

inserting the second, curved tail member into the slot between, a lagging edge of the slot and the first tail member.

20. The method of claim 19 including the step of pressing the second curved member against a correspondingly curved wall of a cavity in communication with the slot to frictionally hold the second tail member with the slot.

21. The method of claim 20 in which said step of pressing is performed in a direction substantially normal to the surface of the second curved tail member at a location thereon where it is pressed to avoid straining the tail member.

22. In a cylinder of a rotary printing press having a gap for mounting receipt of a pair of tail members at opposite ends of a flexible body of a printing plate, the improvement being a narrow gap mounting apparatus for holding the tail members within the mounting gap, comprising:

a cavity within the cylinder and having a pair of walls extending inwardly and backwardly away from each other and from the gap which are conformed relative to the pair of tail members to receive the pair of tail members in mating, overlying relationship with the pair of inwardly and backwardly extending walls, respectively, when fully inserted in the slot;

a locking mechanism within the cavity and including a locking member, and means for moving the locking member to press one of the tail members against its mating wall in a direction substantially transverse thereto and extending away from the other wall to frictionally hold it within the cavity wherein said mating wall is substantially curved.

23. The printing press cylinder of claim 22 in which said locking member is in a direction away form the one tail member.

24. The printing press cylinder of claim 22 in which the locking member is substantially, relatively resilient compared to the pair of walls.

25. The printing press cylinder of claim 23 in which the moving means includes means for rotating the locking member to a locked position in which it is pressed against one of the tails.

26. The printing press cylinder of claim 22 in which said rotating means includes a worm gear linked to the locking member.

27. In a cylinder of a rotary printing press having a gap for mounting receipt of a pair of tail members at opposite ends of a flexible body of a printing plate, the improvement being a narrow gap mounting apparatus for holding the tail members within the mounting gap, comprising:

a cavity within the cylinder and having a pair of walls extending from the gap which are conformed relative to the pair of tail members to receive the pair of tail members in mating, overlying relationship with the pair of walls, respectively, when fully inserted in the slot, the gap having a leading edge and a lagging edge, the mating wall against which said one of the tails is pressed being joined to the lagging edge;

a locking mechanism within the cavity including a locking member, and means for moving the locking member to press one of the tail members against its mating wall in a direction substantially transverse thereto to frictionally hold it within the cavity wherein said mating wall is substantially curved.

28. In a cylinder of a rotary printing press having a gap for mounting receipt of a pair of tail members at opposite ends of a flexible body of a printing plate, the improvement being a narrow gap mounting apparatus for holding the tail members within the mounting gap, comprising:

a cavity within the cylinder and having a pair of walls extending from the gap which are conformed relative to the pair of tail members to receive the pair of tail members in mating, overlying relationship with the pair of walls, respectively, when fully inserted in the slot;

a locking mechanism within the cavity and including a locking member, and means for moving the locking member to press one of the tail members against its mating wall in a direction substantially transverse thereto to frictionally hold it within the cavity, the mating wall against which one of the tails is pressed having a substantially involute shape.

29. The printing plate of claim 1 in combination with a printing press rotary cylinder with a surface around which the planar body is wrapped and a mounting gap within which both the first and second tails are received together.

30. The printing press of claim 6 in which said walls are separated to provide the gap with a dimension substantially less than 0.123 inch and said gap is the only gap in the cylinder.

31. The printing press of claim 6 in which said gap has a leading edge and a lagging edge, the curved wall joins with the lagging edge, and said gap is the only gap in the cylinder.

* * * * *